US008979240B2

(12) United States Patent
Choi

(10) Patent No.: US 8,979,240 B2
(45) Date of Patent: Mar. 17, 2015

(54) HEAD ALIGNMENT ASSEMBLY

(75) Inventor: Geun-Soo Choi, Seoul (KR)

(73) Assignee: DILLI, Gyeonggi-do (KR)

( * ) Notice: Subject to any disclaimer, the term of this patent is extended or adjusted under 35 U.S.C. 154(b) by 0 days.

(21) Appl. No.: 14/127,865

(22) PCT Filed: Apr. 16, 2012

(86) PCT No.: PCT/KR2012/002855
§ 371 (c)(1),
(2), (4) Date: Dec. 19, 2013

(87) PCT Pub. No.: WO2013/133475
PCT Pub. Date: Sep. 12, 2013

(65) Prior Publication Data

US 2014/0160201 A1 Jun. 12, 2014

(30) Foreign Application Priority Data

Mar. 9, 2012 (KR) ..... 10-2012-0024490
Apr. 5, 2012 (KR) ..... 10-2012-0035581

(51) Int. Cl.
*B41J 29/393* (2006.01)
*B41J 2/155* (2006.01)
*B41J 25/00* (2006.01)

(52) U.S. Cl.
CPC ..... *B41J 2/155* (2013.01); *B41J 25/001* (2013.01)
USPC ..... 347/19

(58) Field of Classification Search
CPC ..... B41J 2002/14491; B41J 11/0085; B41J 15/04; B41J 13/0009
See application file for complete search history.

(56) References Cited

U.S. PATENT DOCUMENTS 6,834,948 B2 * 12/2004 Asano et al. ..... 347/102
7,946,669 B2 * 5/2011 Oh et al. ..... 347/8

FOREIGN PATENT DOCUMENTS

JP 2004-090493 A 3/2004
JP 2008-062534 A 3/2008

OTHER PUBLICATIONS

The International Search Report for PCT/KR2012/002855, mailed Jan. 24, 2013.
English abstract of published application No. 2004-090493 A.
English abstract of published application No. 2008-062534 A.
English abstract of KR application No. 10-2008-0015651.
English abstract of KR application No. 10-2008-0105670.

* cited by examiner

*Primary Examiner* — Lamson Nguyen
(74) *Attorney, Agent, or Firm* — Fanelli Haag & Kilger PLLC

(57) ABSTRACT

Disclosed is a head alignment assembly in which a deviation of the head can be aligned conveniently with simple operation from the outside of the printer head section. The head alignment assembly includes a base plate to which at least one head unit is fixed to be exposed downward by a first head support block and a second head support block; a first fine adjustment section configured to shift the first head support block in a longitudinal direction of the head unit; and a second fine adjustment section configured to shift the second head support block in a transverse direction orthogonal to the longitudinal direction of the head unit. The first fine adjustment section includes a first push rod supported by fixed guides which are fixed on the base plate to press the first head support block; and a first handle fixed to one end of the first push rod to move the first push rod in the longitudinal direction. The second fine adjustment section includes a second push block configured to press the second head support block in the transverse direction; a second push rod supported by a plurality of fixed guides which are fixed on the base plate; and a second handle fixed to one end of the second push rod to move the second push rod in the axial direction.

13 Claims, 5 Drawing Sheets

HEAD ALIGNMENT ASSEMBLY

FIELD OF THE INVENTION

The present invention relates to a head alignment assembly, and more specifically to a head alignment assembly in which a deviation of the head can be aligned conveniently with simple operation from the outside of the printer head section.

BACKGROUND OF THE INVENTION

A printer in which a plurality of heads are disposed by aligning them on a base plate to form one head section needs fine adjustment from time to time.

A conventional method for fine adjustment of each head is to use a fine adjustment screw for moving the head to move each head in a biaxial direction on a horizontal plane.

However such a method is cumbersome since fine adjustment is made to the head by disassembling the head section of a shape closed overall by a casing so the head section should be reassembled again. Further, even though the head section is set to the reference position by one fine adjustment, the fine adjustment work should be performed repeatedly by external factors such as repeatedly applied vibration or external shock.

Therefore, the conventional head alignment method has a drawback that not only a long time is taken for fine adjustment work but also alignment work can be performed only by a skilled person who is able to disassemble and assemble the head section.

BRIEF SUMMARY OF THE INVENTION

The present invention is directed to a head alignment assembly comprising: a base plate to which at least one head unit is fixed to be exposed downward by a first head support block and a second head support block; a first fine adjustment section configured to shift the first head support block in a longitudinal direction of the head unit; and a second fine adjustment section configured to shift the second head support block in a transverse direction orthogonal to the longitudinal direction of the head unit; wherein the first fine adjustment section includes a first push rod supported by fixed guides which are fixed on the base plate to press the first head support block; and a first handle fixed to one end of the first push rod to move the first push rod in the longitudinal direction; the second fine adjustment section includes a second push block configured to press the second head support block in the transverse direction; a second push rod supported by a plurality of fixed guides which are fixed on the base plate; and a second handle fixed to one end of the second push rod to move the second push rod in the longitudinal direction.

In some embodiments, the first head support block includes a first notch formed integrally thereon, and the first push rod includes an integral push ring of which one end is formed integrally with the other end of the first push rod and the other end contacts the first notch; and a fixed pin of which a lower end is fixed on the base plate and an upper portion is inserted into the integral push ring to limit a displacement of the first push rod in the longitudinal direction.

In some embodiments, the first head support block includes a first notch formed integrally thereon, and the first push rod includes a first push block of which one end is formed integrally with the other end of the first push rod and the other end has a second notch formed thereon, wherein a separate push ring is disposed between the first notch and the second notch, and a fixed pin formed on the base plate is inserted into the separate push ring to limit the displacement of the first push rod in the longitudinal direction.

In some embodiments, the second head support block includes a driven beam of which one end is formed integrally thereon and the other end protrudes toward the second push block so as to come into contact therewith.

In some embodiments, the second head support block includes a driven beam having a long slit formed therein; and a driven beam pin of which a lower end is fixed on the base plate and an upper portion is inserted into the slit, wherein one end of the driven beam pin comes into contact with the second head support block and the other end of the driven beam comes into contact with a sloping side of the second push block.

In some embodiments, the base plate includes a first reaction force member which applies a reaction force to the second head support block in a direction opposite to a press direction of the first push block; and a second reaction force member which applies a reaction force to the second head support block in a direction opposite to a press direction of the second push block moved by the second push rod.

In some embodiments, the base plate includes a slope reaction force member which applies a reaction force to the second head support block in a diagonal direction between the direction opposite to the press direction of the first push block and the direction opposite to the press direction of the second push block moved by the second push rod.

In some embodiments, the first fine adjustment section includes a first support section configured to press the first push rod in a direction toward the first handle, and the second fine adjustment section includes a second support section configured to press the second push rod in a direction toward the second handle.

In some embodiments, the base plate includes a guide slot formed thereon so as to contact and support the second push block in a direction orthogonal to the longitudinal direction of the second push rod.

In some embodiments, the base plate includes an eccentric bearing which contacts a surface opposite to the sloping side of the second push block in contact with the driven beam of the second head support block; and an eccentric bolt on which the eccentric bearing is rotatably mounted.

In some embodiments, the driven beam includes a driven bearing installed at an end portion of the driven beam so as to provide a smooth contact with the second push block.

In some embodiments, when two or more heads are arranged on the base plate in serial, the first push rod and the second push rod are installed parallel to each other with different heights.

DETAILED DESCRIPTION OF THE INVENTION

Figure 1:
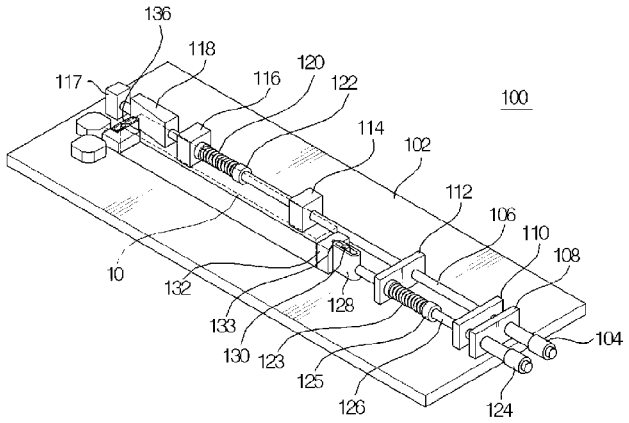
FIG. 1 is a perspective view of a head alignment assembly according to a first embodiment of the present invention.

Accordingly, to solve the above-mentioned problems, it is an object of the present invention to provide a head alignment assembly in which a deviation of the head can be aligned conveniently by a simple operation from the outside of the printer head section.

Technical Solution

In order to accomplish the foregoing objects, according to the present invention, there is provided a head alignment assembly including: a base plate to which at least one head unit is fixed to be exposed downward by a first head support block and a second head support block; a first fine adjustment section configured to shift the first head support block in a longitudinal direction of the head unit; and a second fine adjustment section configured to shift the second head support block in a transverse direction orthogonal to the longitudinal direction of the head unit; wherein the first fine adjustment section includes a first push rod supported by fixed guides which are fixed on the base plate to press the first head support block; and a first handle fixed to one end of the first push rod to move the first push rod in the longitudinal direction; the second fine adjustment section includes a second push block configured to press the second head support block in the transverse direction; a second push rod supported by a plurality of fixed guides which are fixed on the base plate; and a second handle fixed to one end of the second push rod to move the second push rod in the longitudinal direction.

Preferably, the first head support block includes a first notch formed integrally thereon, and the first push rod includes an integral push ring of which one end is formed integrally with the other end of the first push rod and the other end contacts the first notch; and a fixed pin of which a lower end is fixed on the base plate and an upper portion is inserted into the integral push ring to limit a displacement of the first push rod in the longitudinal direction.

Preferably, the first head support block includes a first notch formed integrally thereon, and the first push rod includes a first push block of which one end is formed integrally with the other end of the first push rod and the other end has a second notch formed thereon, wherein a separate push ring is disposed between the first notch and the second notch, and a fixed pin formed on the base plate is inserted into the separate push ring to limit the displacement of the first push rod in the longitudinal direction.

Preferably, the second head support block includes a driven beam of which one end is formed integrally thereon and the other end protrudes toward the second push block so as to come into contact therewith.

Preferably, the second head support block includes a driven beam having a long slit formed therein; and a driven beam pin of which a lower end is fixed on the base plate and an upper portion is inserted into the slit, wherein one end of the driven beam pin comes into contact with the second head support block and the other end of the driven beam comes into contact with a sloping side of the second push block.

Preferably, the base plate includes a first reaction force member which applies a reaction force to the second head support block in a direction opposite to a press direction of the first push block; and a second reaction force member which applies a reaction force to the second head support block in a direction opposite to a press direction of the second push block moved by the second push rod.

Preferably, the base plate includes a slope reaction force member which applies a reaction force to the second head support block in a diagonal direction between the direction opposite to the press direction of the first push block and the direction opposite to the press direction of the second push block moved by the second push rod.

Preferably, the first fine adjustment section includes a first support section configured to press the first push rod in a direction toward the first handle, and the second fine adjustment section includes a second support section configured to press the second push rod in a direction toward the second handle.

Preferably, the base plate includes a guide slot formed thereon so as to contact and support the second push block in a direction orthogonal to the longitudinal direction of the second push rod.

Preferably, the base plate includes an eccentric bearing which contacts a surface opposite to the sloping side of the second push block in contact with the driven beam of the second head support block; and an eccentric bolt on which the eccentric bearing is rotatably mounted.

Preferably, the driven beam includes a driven bearing installed at an end portion of the driven beam so as to provide a smooth contact with the second push block.

Preferably, when two or more heads are arranged on the base plate in serial, the first push rod and the second push rod are installed parallel to each other with different heights.

Advantageous Effects

According to the present invention, the fine adjustment of the head can be carried out just with a simple operation of a handle even by an unskilled person. As a result, it is possible to save both the time and cost taken for fine adjustment work. Further, it is more economical because it is also possible to minimize the delay of print out work due to the head fine adjustment.

In addition, it is possible to improve the printing quality as the head of the head section can be set accurately to the reference position.

Hereinafter, preferable embodiments of the present invention will be described with reference to the accompanying drawings. Referring to the drawings, wherein like reference characters designate like or corresponding parts throughout the several views. In the embodiments of the present invention, detailed description of the publicly known functions and configurations that are judged to be able to make the purport of the present invention unnecessarily obscure are omitted.

The biggest characteristic of the head alignment assembly according to first to fourth embodiments of the present invention is in that the alignment of the head unit can be simply adjusted from the outside of the head section without disassembly-assembly work of the head section.

Figure 2:
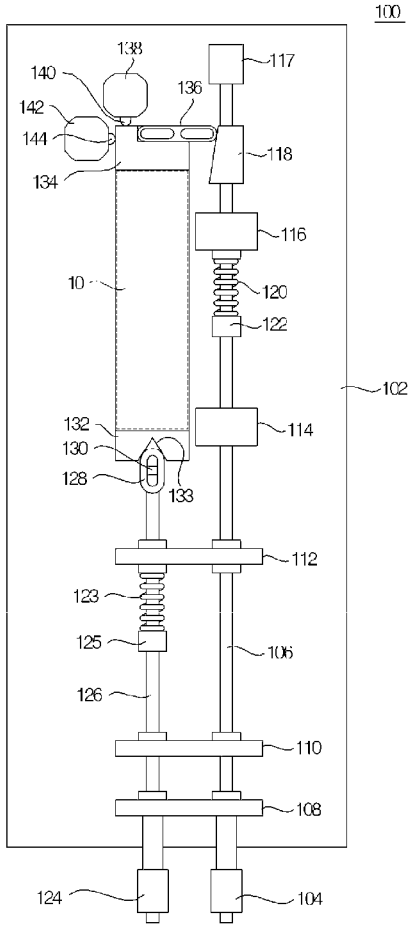
FIG. 2 is a plane view of FIG. 1.

For such a characteristic, a head alignment assembly 100 according to the first embodiment includes a first handle 124 and a second handle 104 exposed outside of the head section, as illustrated in FIGS. 1 and 2. By using the first handle 124 and the second handle 104, it is possible to fine adjust a head unit 10 arranged inside of the head section.

Such a head alignment assembly 100 includes a base plate 102 to which the head unit 10 is fixed to be exposed downward by a first head support block 132 and a second head support block 134, a first fine adjustment section for allowing a displacement of the first head support block 132 in a longitudinal direction of the head unit 10, and a second fine adjustment section for allowing the displacement of the second head support block 134 in a transverse direction orthogonal to the longitudinal direction of the head unit 10.

A plurality of head units 10 may be mounted on the base plate 102, and slits of a number equal to the head units 10 for the head units 10 to be exposed downward of the base plate 102 are formed on the base plate 102. Accordingly, when the plurality of head units 10 are disposed in parallel on the base plate 102, head alignment assemblies 100 of a number equal to the number of the head units 10 are disposed in parallel.

The first head support block 132 and the second head support block 134 are installed in the slit, and the head unit 10 is fixed integrally to the first head support block 132 and the second head support block 134. Therefore, the displacement of the head unit 10 is made by the shifting of the first head support block 132 and the second head support block 134.

The first fine adjustment section includes a first notch 133 formed on the first head support block 132 for allowing the displacement of the head unit 10 in the longitudinal direction thereof, a first push rod 126 supported by fixed guides 108, 110 and 112 fixed on the base plate 102, the first handle 124 fixed to one end of the first push rod 126 so as to move the first push rod 126 in the longitudinal direction, an integral push ring 128 of which one end is formed integrally with the other end of the first push rod 126 and the other end contacts the first notch 133, and a fixed pin 130 inserted into the integral push ring 128 to be fixed on the base plate 102.

A lower end of the fixed pin 130 is fixed on the base plate 102 to protrude upward and an upper portion thereof is inserted into the integral push ring 128 fixed to the other end portion of the first push rod 126. Accordingly, the moving length of the first push rod 126 in the longitudinal direction thereof is limited by the fixed pin 130 within the length of the slot of the integral push ring 128 formed integrally therein.

The width of the slot formed inside of the integral push ring 128 is formed wider than the diameter of the fixed pin 130 to provide a slight interval for the integral push ring 128.

This interval defines an offset section between the first head support block 132 and the first push rod 126 when the first push rod 126 moves in the longitudinal direction thereof, so that it can provide a clearance to enable the head unit 10 to change position during the fine adjustment by the second fine adjustment section. Further, it is preferable that the internal slit of the integral push ring 128 be formed lengthwise in the longitudinal direction, and the fixed pin 130 have a cross section shape (for example, a rectangular shape) in contact with both sidewalls of the internal slit, so that the integral push ring 128 can move only vertically to the fixed pin 130.

Further, the first head support block 132 includes the first notch 133 that contacts the outer periphery of the integral push ring 128. In particular, as illustrated in FIG. 1, the first notch 133 is formed in substantially a "V" shape and the other end of the integral push ring 128 is formed in an elliptical shape, so that they make two-point contact. Therefore, left and right movement of the first head support block 132 is prevented, and the central axis of the integral push ring 128 normally coincides with the center of the first notch 133 so as to make it move only in the forward and backward direction (the longitudinal direction of the head 10).

In addition, in order to move the first push rod 126 in the longitudinal direction thereof, a female screw (not shown) is formed on an inner wall of the first handle 124 and a male screw (not shown) is formed on an outer surface of the first push rod 126. Next, the basic principle of operation of the first handle 124 will be described. The female screw of the first handle 124 and the male screw of the first push rod 126 are screwed into each other. Therefore, if the first handle 124 rotates, the first push rod 126 moves forward or backward in the longitudinal direction thereof.

Further, the first push rod 126 includes a first support section so as to press the first push rod 126 to be retreated in the longitudinal direction (to be moved in the direction of the first handle 124). In the present embodiment, the first support section illustrates a first compression spring 123 mounted on the first push rod 126. One end of the first compression spring 123 is supported by a first spring seat portion 125 formed integrally on the first push rod 126, and the other end thereof is supported by a fixed guide 112. As a result, an axial force normally acts on the first handle 124 by an elastic force of the first compression spring 123, so that backlash generated from the screwed portion inside of the first handle 124 is removed. Therefore, so called a backlash phenomenon can be prevented by the first compression spring 123.

The second fine adjustment section that shifts the second head support block 134 in the transverse direction of the head unit 10 includes a driven beam 136 formed integrally with the second head support block 134, a second push block 118 of which one end is fixed to a second push rod 106 and the other contacts the driven beam 136 so as to press the second head support block 134 in the transverse direction, the second push rod 106 supported by a plurality of fixed guides 108, 110, 112, 114, 116 and 117 fixed on the base plate 102, and the second handle 104 fixed to one end of the second push rod 106 so as to move the second push rod 106 in the longitudinal direction.

The second push block 118 has a sloping side with a cross section of substantially triangular or trapezoidal shape. Therefore, if the second push block 118 moves forward, the driven beam 136 can be retreated by the sloping side in a direction away from the second push block 118 in the transverse direction of the head unit 10. The tip of the driven beam 136 is preferably rounded to prevent damage by friction with the second push block 118. At this time, the driven beam 136 comes into contact with the sloping side of the second push block 118, in a state protruding outward of the second head support block 134. The second push block 118 is formed integrally in the other end portion of the second push rod 106 which is disposed at a given interval with the head unit 10.

Further, the second push rod 106 includes a second support section so as to press the second push rod 106 to be retreated in the longitudinal direction (to be moved in the direction of the second handle 104). In the present embodiment, the second support section illustrates a second compression spring 120 mounted on the second push rod 106. One end of the second compression spring 120 is supported by a second spring seat portion 122 formed integrally on the second push rod 106, and the other end thereof is supported by a fixed guide 116. As a result, the axial force normally acts on the second handle 104 by the elastic force of the second compression spring 120, so that backlash generated from the screwed portion inside of the second handle 104 is removed. Therefore, the backlash phenomenon can be prevented by the second compression spring 120.

The first and second support sections are not limited to the ones illustrated in the embodiments of the present invention, but a variety of modifications are possible by applying the techniques known in the art.

In addition, the second head support block 134 includes a first reaction force member 138 and a second reaction force member 142. The second reaction force member 142 opposed to the second push block 118 applies a reaction force to the second head support block 134 in a direction opposite to the press direction of the second push block 118, and the first reaction force member 138 opposed to the second head support block 134 in the longitudinal direction applies a reaction force to the second head support block 134 in a direction orthogonal to the second reaction force member 142. Springs (not shown) for applying the reaction force are installed inside of the first reaction force member 138 and the second reaction force member 142, and a first reaction force protrusion 140 and a second reaction force protrusion 144 are coupled to the end portions of the springs.

The first reaction force protrusion 140 and the second reaction force protrusion 144 disposed at right angles to each other contact the end face and the side face of the second head support block 134, respectively.

Accordingly, the first reaction force member 138 and the second reaction force member 142 provide the reaction force respectively against the pressing force applied to the first head support block 132 and the second head support block 134 by the first handle 124 and the second handle 104, so that it is possible to hold an adjusted position of the head unit 10.

The head alignment assembly 100 according to the first embodiment of the present invention has a configuration basically as described above. Hereinafter, the process of fine adjustment of the head unit 10 by the head alignment assembly 100 having such a configuration will be described.

It is possible to fine-adjust the position of the head unit 10 at every predetermined time or if abnormality is found on the printed matter. Especially if a camera that can photograph the print out result, in which an image, for example, is printed by the head section, is installed additionally in the printer, it is possible to fine-adjust the head unit 10 more finely than with a naked eye.

The image for fine-adjustment is printed by operating the printer for fine adjustment and the printed image is photographed by a camera, and then a deviation of the head unit 10 deviating from the reference position is measured by comparing the photographed image and the stored image. After that, based on the measured deviation, the operator corrects the head unit 10 by rotating the first handle 124 and the second handle 104.

After correcting the position of the head unit 10, the image is printed again, and the printed image is photographed by the camera, and then the deviation of the head unit 10 deviating from the reference position is measured again by comparing the photographed image and the stored image. After that, based on the measured deviation, the moving direction and moving amount of the first push rod 126 and the second push rod 106 by the first handle 124 and the second handle 104 are checked again.

When fine adjustment is completed by repeatedly carrying out the above processes, print out work is started again. If a locking device is additionally installed on the first handle 124 and second handle 104, it is preferable to suppress the deviation generated in the head unit 10 by preventing the rotation of the first and second handles 124 and 104 by the locking device after completing fine adjustment.

Figure 3:
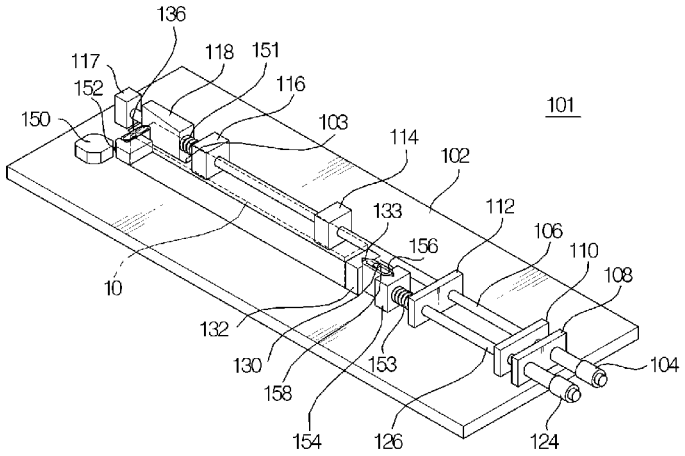
FIG. 3 is a perspective view of a head alignment assembly according to a second embodiment of the present invention.
Figure 4:
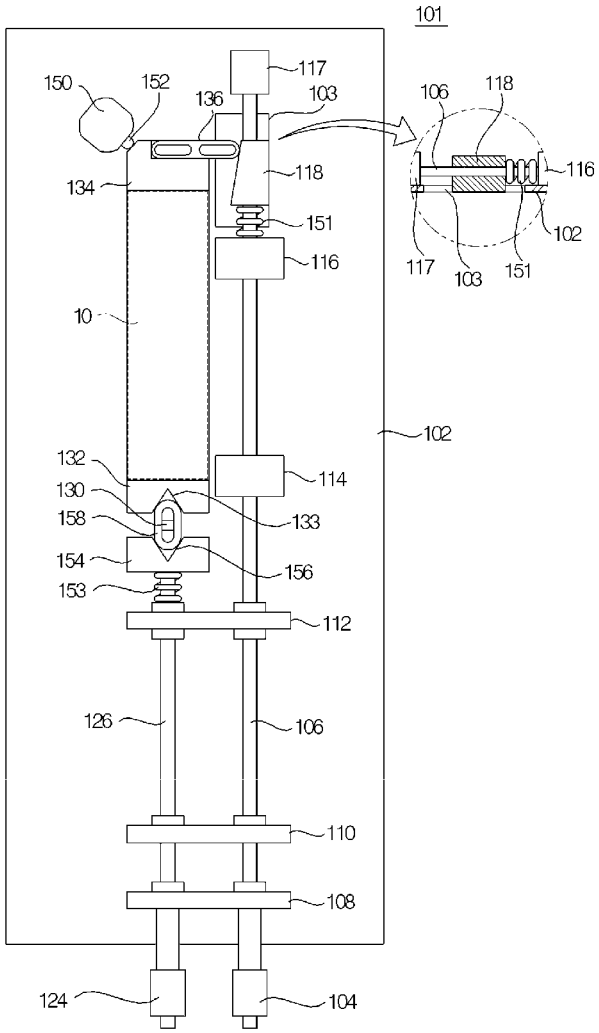
FIG. 4 is a plane view of FIG. 3.

Next, with reference to FIGS. 3 and 4, another head alignment assembly 101 according to a second embodiment of the present invention will be described. The head alignment assembly 101 is basically the same as the head alignment assembly 100 of the first embodiment. However, compared to the first embodiment, the first reaction force member 138 and the second reaction force member 142 are replaced by a slope reaction force member 150, and a separate push ring 158 is employed instead of the integral push ring 128, so that the separate push ring 158 is indirectly pressed through a first push block 154 formed integrally with the first push rod 126. Further, the positions and structures of the first and second support sections are different, and a guide slot 103 formed so as to guide the second push block 118 is additionally provided.

It is possible to configure the slope reaction force member 150 by integrating the first reaction force member 138 and the second reaction force member 142 of the head alignment assembly 100 of the first embodiment into one mechanism by pressing the corner of the second head support block 134 in diagonal direction. Further, for this, it is preferable that a seat portion where the end portion of a diagonal reaction force protrusion 152 of the slope reaction force member 150 comes into contact be formed on the corner of the second head support block 134.

Further, one end of the first push block 154 is formed integrally with one end of the first push rod 126, and the other end thereof is provided with a second notch 156 corresponding to the first notch 133. One end of the separate push ring 158 contacts the second notch 156 of the first push block 154 and the other end thereof contacts the first notch 133 of the first head support block 132. Accordingly, both ends of the separate push ring 158 make two-point contacts respectively with the first notch 133 and the second notch 156, so that the central axis of the separate push ring 158 normally coincides with the central axes of the first notch 133 and the second notch 156. In addition, the moving length of the separate push ring 158 in the longitudinal direction is limited within a predetermined range (that is, the length of the internal slot) by the fixed pin 130. Accordingly, the first push block 154 formed integrally with the first push rod 126 by forward movement of the first push rod 126 moves in the longitudinal direction. As a result, the separate push ring 158 is pressed to be moved. In addition, the first head support block 132 may be pressed by the separate push ring 158 to move in the longitudinal direction. On the other hand, if the first push rod 126 moves backward, the first head support block 132 is retreated by the slope reaction force member 150.

In addition, the first and second support sections may be one short first compression spring 153 and one short second compression spring 151. The first compression spring 153 is mounted on the first push rod 126 between the first push block 154 and the fixed guide 112, and the second compression spring 151 is mounted on the second push rod 106 between the second push block 118 and the fixed guide 116. Accordingly, it is possible to hold the positions of the first push rod 126 and the second push rod 106 by the support of the first and second compression springs against the reaction force of the slope reaction force member 150.

Further, the second push block 118 has one side formed of a plane parallel to the longitudinal direction of the second push rod 106, and a guide slot 103 that contacts the plane of the second push block 118 is formed on the base plate 102.

Accordingly, the second push block 118 is supported by the guide slot 103, so it is possible to prevent deformation of the second push rod 106 due to the reaction force of the slope reaction force member 150 acting continuously through the driven beam 136.

Next, with reference to FIG. 5, a head alignment assembly 105 according to a third embodiment of the present invention will be described. The head alignment assembly 105 according to the present embodiment is basically the same as the head alignment assembly 100 of the first embodiment. However, compared to the first embodiment, the head alignment assembly 105 includes an eccentric bearing 172 installed to support the second push block 118, a second support section 160 installed to support and press the second push rod 106, a coupler 174 connecting the first handle 124 and the first push rod 126 and a coupler 180 connecting the second handle 104 and the second push rod 106. In addition, a driven beam 184 separated from a second head support block 182 is employed instead of the driven beam 136 formed integrally on the second head support block 134.

The eccentric bearing 172 contacts a surface opposite to the sloping side of the second push block 118 in contact with the driven beam 184. Accordingly, the eccentric bearing 172 plays a role of preventing the deformation of the second push rod 106 generated by the first and second reaction force members 138 and 142, likewise with the guide slot 103. The eccentric bearing 172 is rotatably mounted on an eccentric bolt 170 fixed on the base plate 102. Accordingly, it is possible to change the position of the eccentric bearing 172 by rotating the eccentric bolt 170. Therefore, it is possible to adjust the fine interval between the second push block 118 and the eccentric bearing 172 by the eccentric bolt 170.

Figure 5:
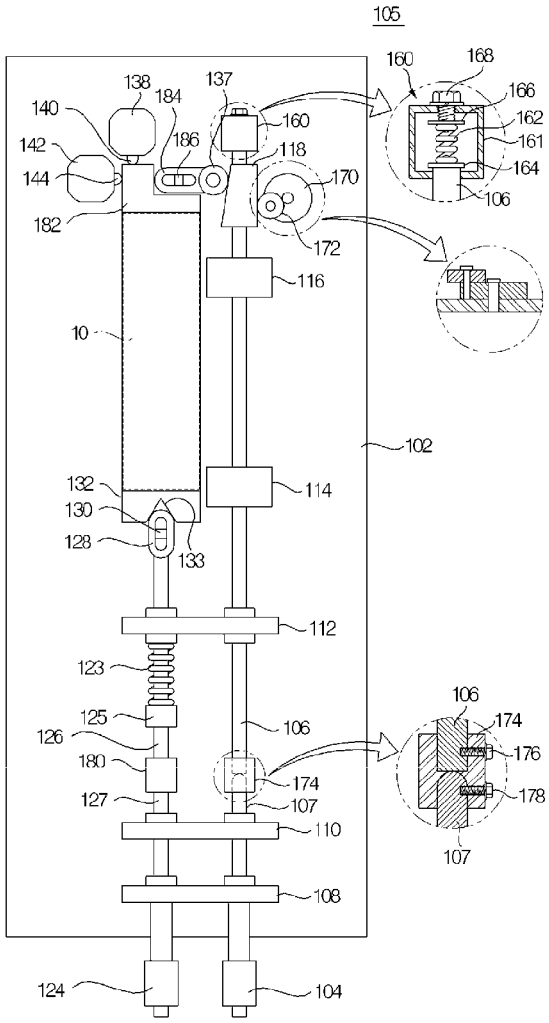
FIG. 5 is a plane view of a head alignment assembly according to a third embodiment of the present invention.

In addition, the second head support block 182 is formed in substantially an 'L' letter shape, as illustrated in FIG. 5, and the driven beam 184 is installed in the bent portion thereof.

The driven beam 184 is a substantially elliptical ring having a slit therein, and an upper portion of a driven beam pin 186 of which a lower end is fixed on the base plate 102 is inserted into the slit. The driven beam pin 186 has a cross section of substantially rectangular or square shape so as to guide the driven beam 184 to move in a straight line. In addition, one end of the driven beam 184 comes into contact with the second head support block 182, and the other end of the driven beam 184 comes into contact with the sloping side of the second push block 118. Especially, a driven bearing 137 may be installed at the end portion of the driven beam 184 so as to provide a smooth contact between the second push block 118 and the driven beam 184.

The second support section 160 includes a support casing 161 having a space therein, and a second compression spring 162 which is installed in the support casing 161 to press one end of the second push rod 106 inserted into the casing. Further, an adjustment bolt 168 for adjusting the reaction force of the second compression spring 162 may mounted on the support casing 161 on the opposite side of the second push rod 106. In this case, washers 164 and 166 are arranged at both ends of the second compression spring 162 to prevent the second compression spring 162 from being rotated by the rotation of the adjustment bolt 168. The outside ends of the washers 164 and 166 are in contact with one end of the second push rod 106 and the adjustment bolt 168 respectively.

The couplers 174 and 180 are used for the case that the handle axes 107 and 127 of the first and second handles 104 and 124 are protruded lengthwise. That is, the coupler 174 connects the second push rod 106 and the handle axis 107, and the coupler 180 connects the first push rod 126 and the handle axis 127.

The couplers 174 and 180 connect one end of the push rod and one end of the handle axes by coupling bolts 176 and 178.

Next, with reference to FIG. 6 and FIG. 7, a head alignment assembly 200 according to a fourth embodiment of the present invention will be described. The head alignment assembly 200 is basically the same as the head alignment assembly 100 of the first embodiment. However, compared to the first embodiment, when head units 12 and 14 are disposed in a row in the longitudinal direction on a base plate 202, or the distance between the central axes of two head units is so short that the space is not enough for the first and second push rods to be inserted, first and second push rods 252 and 276; and 206 and 230 are installed in parallel with each other on different levels.

For this, the head alignment assembly 200 includes two first head support blocks 262 and 286, two second head support blocks 266 and 290, a first fine adjustment section for allowing the displacement of the head support blocks 262 and 286 in the longitudinal direction of the head unit 10, and a second fine adjustment section for allowing the displacement of the second head support blocks 266 and 290 in the transverse direction orthogonal to the longitudinal direction of the head units 12 and 14.

The first and second push rods 252 and 276; and 206 and 230 are supported by fixed guides 208, 210, 212, 214, 216, 218, 220, 222, 224, and 226 which are installed on the base plate 202 in parallel with each other on different levels.

Integral push rings 258 and 282 have height different from each other so as to be fixed integrally to the first push rods 252 and 276 with different heights. That is, the height of the integral push ring 258 on the side close to the first handles 250 and 274 is lower than the height the integral push ring 282 on the far side.

In addition, it is preferable to form the length of the fixed pins 260 and 284 differently depending on the heights of the integral push rings 258 and 282.

The second push blocks 236 and 242 have the thickness different so as to be fixed integrally to the second push rods 206 and 230 with different heights. That is, the thickness of the second push block 236 close to the second handles 204 and 228 is smaller than the thickness of the second push block 242 on the far side.

Besides of these, the configuration of first reaction force members 270 and 294, second reaction force members 272 and 296, first compression springs 256 and 280, first spring seat portions 254 and 278, second compression springs 234 and 240, second spring seat portions 232 and 238, driven beams 268 and 292, and the second head support blocks 266 and 290 is the same as the first embodiment, so detailed description thereof is omitted.

Figure 6:
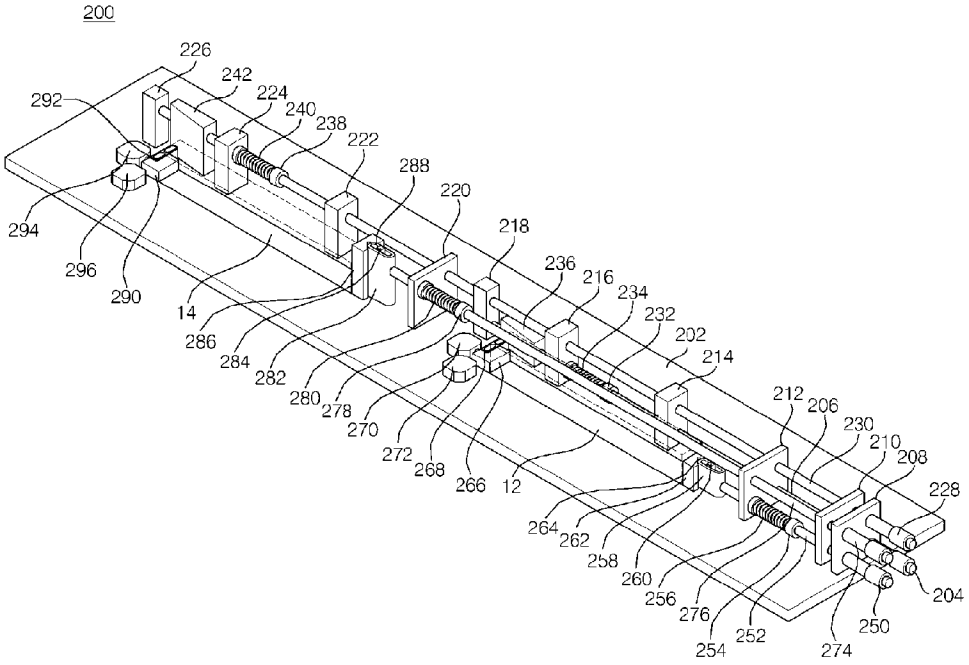
FIG. 6 is a perspective view of a head alignment assembly according to a fourth embodiment of the present invention.
Figure 7:
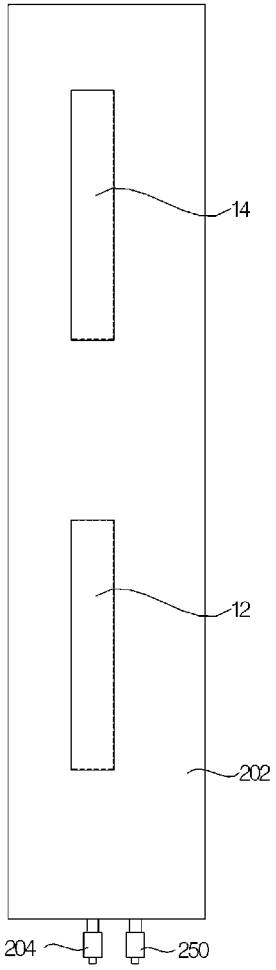
FIG. 7 is a bottom view of FIG. 6.

Further, in the first head support blocks 262 and 286, it is also possible to increase the thickness of the first head support block 286 disposed far from the first handles 250 and 274, as illustrated in FIG. 6. The shape of the first notches 264 and 288 formed on the first head support blocks 262 and 286 is the same as the first embodiment.

Although the present invention has been described in connection with the exemplary embodiments illustrated in the drawings, it is only illustrative. It will be understood by those skilled in the art that various modifications and equivalents can be made to the present invention. Therefore, the true technical scope of the present invention should be defined by the appended claims.

DESCRIPTION OF REFERENCE NUMERALS IN DRAWINGS

10,12,14: head unit
100,101,105,200: head alignment assembly
102,202: base plate
103: guide slot
104,204,228: second handle
106,206,230: second push rod
107,127: handle axis
108,110,112,114,116,208,210,212,214,216,218,220,222,224,226: fixed guide
118,236,242: second push block
120,151,162,234,240: second compression spring
122,232,238: second spring seat portion
123,153,256,280: first compression spring
124,250,274: first handle
125,254,278: first spring seat portion
126,252,276: first push rod
128,282,258: integral push ring
130,260,284: fixed pin
132,262,286: first head support block
133,264,288: first notch
134,182,266,290: second head support block
136,184,268,292: driven beam
137: driven bearing
138,270,294: first reaction force member
140: first reaction force protrusion

142,272,296: second reaction force member
144: second reaction force protrusion
150: single reaction force member
152: diagonal reaction force protrusion
154: first push block
156: second notch
158: separate push ring
160: second support section
161: support casing
164,166: washer
168: adjustment bolt
170: eccentric bolt
172: eccentric bearing
174,180: coupler
176,178: coupling bolt
186: driven beam pin.

CONCLUSION

All of the various embodiments or options described herein can be combined in any and all variations. While the invention has been particularly shown and described with reference to some embodiments thereof, it will be understood by those skilled in the art that they have been presented by way of example only, and not limitation, and various changes in form and details can be made therein without departing from the spirit and scope of the invention. Thus, the breadth and scope of the present invention should not be limited by any of the above described exemplary embodiments, but should be defined only in accordance with the following claims and their equivalents.

All documents cited herein, including journal articles or abstracts, published or corresponding U.S. or foreign patent applications, issued or foreign patents, or any other documents, are each entirely incorporated by reference herein, including all data, tables, figures, and text presented in the cited documents.

What is claimed is:

1. A head alignment assembly comprising:

a base plate to which at least one head unit is fixed to be exposed downward by a first head support block and a second head support block;

a first fine adjustment section configured to shift the first head support block in a longitudinal direction of the head unit; and a second fine adjustment section configured to shift the second head support block in a transverse direction orthogonal to the longitudinal direction of the head unit;

wherein the first fine adjustment section includes a first push rod supported by fixed guides which are fixed on the base plate to press the first head support block; and a first handle fixed to one end of the first push rod to move the first push rod in the longitudinal direction; the second fine adjustment section includes a second push block configured to press the second head support block in the transverse direction;

a second push rod supported by a plurality of fixed guides which are fixed on the base plate; and a second handle fixed to one end of the second push rod to move the second push rod in the longitudinal direction.

2. The head alignment assembly according to claim 1, wherein the first head support block includes a first notch formed integrally thereon, and the first push rod includes an integral push ring of which one end is formed integrally with the other end of the first push rod and the other end contacts the first notch; and a fixed pin of which a lower end is fixed on the base plate and an upper portion is inserted into the integral push ring to limit a displacement of the first push rod in the longitudinal direction.

3. The head alignment assembly according to claim 1, wherein the first head support block includes a first notch formed integrally thereon, and the first push rod includes a first push block of which one end is formed integrally with the other end of the first push rod and the other end has a second notch formed thereon, wherein a separate push ring is disposed between the first notch and the second notch, and a fixed pin formed on the base plate is inserted into the separate push ring to limit the displacement of the first push rod in the longitudinal direction.

4. The head alignment assembly according to claim 1, wherein the second head support block includes a driven beam of which one end is formed integrally thereon and the other end protrudes toward the second push block so as to come into contact therewith.

5. The head alignment assembly according to claim 4, wherein the driven beam includes a driven bearing installed at an end portion of the driven beam so as to provide a smooth contact with the second push block.

6. The head alignment assembly according to claim 1, wherein the second head support block includes a driven beam having a long slit formed therein; and a driven beam pin of which a lower end is fixed on the base plate and an upper portion is inserted into the slit, wherein one end of the driven beam pin comes into contact with the second head support block and the other end of the driven beam comes into contact with a sloping side of the second push block.

7. The head alignment assembly according to claim 6, wherein the driven beam includes a driven bearing installed at an end portion of the driven beam so as to provide a smooth contact with the second push block.

8. The head alignment assembly according to claim 1, wherein the base plate includes a first reaction force member which applies a reaction force to the second head support block in a direction opposite to a press direction of the first push block; and a second reaction force member which applies a reaction force to the second head support block in a direction opposite to a press direction of the second push block moved by the second push rod.

9. The head alignment assembly according to claim 1, wherein the base plate includes a slope reaction force member which applies a reaction force to the second head support block in a diagonal direction between the direction opposite to the press direction of the first push block and the direction opposite to the press direction of the second push block moved by the second push rod.

10. The head alignment assembly according to claim 1, wherein the first fine adjustment section includes a first support section configured to press the first push rod in a direction toward the first handle, and the second fine adjustment section includes a second support section configured to press the second push rod in a direction toward the second handle.

11. The head alignment assembly according to claim 1, wherein the base plate includes a guide slot formed thereon so as to contact and support the second push block in a direction orthogonal to the longitudinal direction of the second push rod.

12. The head alignment assembly according to claim 1, wherein the base plate includes an eccentric bearing which contacts a surface opposite to the sloping side of the second push block in contact with the driven beam of the second head support block; and an eccentric bolt on which the eccentric bearing is rotatably mounted.

13. The head alignment assembly according to claim 1, wherein, when two or more heads are arranged on the base plate in serial, the first push rod and the second push rod are installed parallel to each other with different heights.

* * * * *